US006155339A

United States Patent [19]

Grapengater

[11] Patent Number: 6,155,339

[45] Date of Patent: Dec. 5, 2000

[54] OBROUND HEADER FOR A HEAT EXCHANGER

[76] Inventor: Richard B. Grapengater, 5410 E. 105th Pl. South, Tulsa, Okla. 74136

[21] Appl. No.: 09/336,086

[22] Filed: Jun. 18, 1999

[51] Int. Cl.[7] ..... F28F 9/02

[52] U.S. Cl. ..... 165/173; 165/175; 165/144

[58] Field of Search ..... 165/148, 151, 165/153, 173, 140, 144, 176, 175; 29/890.052

[56] References Cited

U.S. PATENT DOCUMENTS

| | | | |
|---|---|---|---|
| 2,044,457 | 6/1936 | Young | 165/173 |
| 3,265,126 | 8/1966 | Donaldson | 165/153 |
| 4,932,469 | 6/1990 | Beatenbough | 165/153 |
| 5,303,770 | 4/1994 | Dierbeck | 165/140 |
| 5,383,517 | 1/1995 | Dierbeck | 165/144 |
| 5,706,887 | 1/1998 | Takeshita et al. | 165/151 |

*Primary Examiner*—Ira S. Lazarus
*Assistant Examiner*—Terrell McKinnon
*Attorney, Agent, or Firm*—Fellers, Snider, Blankenship, Bailey & Tippens; Brent A. Capehart

[57] ABSTRACT

An obround header of obround cross-section for a heat exchanger and a process for forming such a header. An obround header of obround cross-section has sidewalls with flat inner and outer portions. A curved transition between the opposing sidewalls minimizes stress concentrations within the header. The flat portions of the sidewalls provide a planar surface, for which it is easier to drill tube openings and access plug holes and install tubes and plugs. The flat surfaces, along with the opposed holes and openings, make installing and cleaning the tubes easier. A fluid nozzle provides an inlet or outlet for the fluid. The process for making the flat sidewalls is by forming material from a round cross-sectional geometry to an obround shape.

19 Claims, 2 Drawing Sheets

OBROUND HEADER FOR A HEAT EXCHANGER

BACKGROUND OF THE INVENTION

1. Field of the Invention

The invention relates to headers for air-cooled heat exchangers.

2. Description of the Related Art

Air-cooled heat exchangers are items of equipment frequently used in industrial applications. Flowing a fluid, whether liquid or gas, through a series of tubes and drafting atmospheric air across the exterior of the tubes using one or more fans causes a heat transfer between the fluid and the atmosphere.

Air-cooled heat exchangers are commonly made for industrial applications by use of two spaced-apart headers. Tubes extend between the headers. The tubes are often finned and typically spaced closely together with one or more fans blowing atmospheric air over the tubes. The headers physically support and connect the tubes so that fluid will flow through all tubes. The headers with connected tubes and side frames which support a pair of opposed headers comprise an air-cooled exchanger section.

There are many types of headers, most of which have rectangular or round cross-section, and some of which have an oval cross-section. For example, Knülle (U.S. Pat. No. 4,130,398) discloses oval-shaped headers attached to double pipe elements.

Mosier (U.S. Pat. No. 3,689,972) discloses a pair of oval-shaped headers where the fluid tubes intersect the headers at highly curved portions of the headers.

Takeshita (U.S. Pat. No. 5,706,887) discloses a pair of headers of elliptic cross-section, connected by a single row of fluid tubes near the flatter portion of the ellipse. Other related patents are listed in the following table:

| PATENT NO. | INVENTOR | TITLE |
|---|---|---|
| 1,929,365 | Mautsch | Heat Exchange Apparatus |
| 3,689,972 | Mosier et al. | Method of Fabricating a Heat Exchanger |
| 4,130,398 | Knülle | Oval Header Heat Exchanger and Method of Producing the Same |
| 4,168,744 | Knülle et al. | Oval Header Heat Exchanger |
| 5,036,914 | Nishishita | Vehicle-Loaded Parallel Flow Type Heat Exchanger |
| 5,069,277 | Nakamura et al. | Vehicle-Loaded Heat Exchanger of Parallel Flow Type |
| 5,076,354 | Nishishita | Multiflow Type Condenser for Car Air Conditioner |
| 5,092,398 | Nishishita et al. | Automotive Parallel Flow Type Heat Exchanger |
| 5,706,887 | Takeshita et al. | Air Conditioner and Heat Exchanger Used Therefor |
| 5,727,626 | Kato | Header Tank of Heat Exchanger |
| DE 2,500,827 | Schmidt | Double Tube Heat Exchanger Having Oval Collection Headers The Transfer Pieces Being Rolled Not Welded |

There are problems with headers of existing art.

A rectangular header requires extensive welding to configure six flat steel plates into a rectangular box header. The four long seams at corner joints where the edges of the top, bottom, and side plates join together require welding as do the corner joints of the end plates where the two end plates join to the top, bottom, and side plates. In addition to the long length of these long seam welds, the depth of these welds increase with the thickness of the top and bottom plates to handle incremental pressure containment. These long corner joint welds result in significant fabrication time and expense. Hours of welding time and additional welding material are required for multiple weld passes to join the plates and fill the beveled joints. Additional expenses may incur for non-destructive testing on welded joints and possible rework of welded joints which fail non-destructive tests. Rework involves removal of welding material in the defective area, rewelding and re-testing.

There are other problems with headers of the existing art. Rectangular headers have right angle corners. Because the headers are under internal fluid pressure, there are stress concentrations acting at the right angle corners within the header walls. These stress concentrations contribute to potential failure of the header. Thus, it is generally preferred to have curved internal surfaces in pressure vessels.

Changing the header cross-section to a circle or oval partially solves this problem of large stress concentrations, but creates other problems. It is generally desired to have the tubes parallel to one another. Thus, when drilling openings in the header to receive the tubes, the drill bit must be maintained in a position normal to a diameter of the circular cross-section. Maintaining this angle makes effective drilling difficult at the top and bottom of a circular header, because the angle between the drill bit and the header surface becomes small. A related problem for headers of circular or oval cross-section is that it is more difficult to position and attach the tubes to a curved surface than it is to position and attach the tubes to a flat surface.

A further problem for curved cross-sections on the tube sheet portion of the header which is connected to the tubes is in the rolled connection of the tube to the header. The connection is typically made by inserting the tube into the tube hole and expanding the tube by the use of a rolling tool which is inserted into the interior of the portion of the tube within the thickness of the tube sheet portion of the header and expanding the outer circumference of the tube against the interior surface of the tube hole. It is undesirable to expand the tube beyond the outer wall of the tube sheet portion of the header since the tube may be weakened if this occurs. On curved tube sheet portions, the length of the tube which may be rolled is minimized as compared to headers with flat tube sheet portions.

Another problem for headers of circular or oval cross-sections is when the internal diameter of the tube holes in the tube sheet portion of the header are grooved for incremental tube-to-header securement. On curved cross-sections of the inner tube sheet wall, the area available for grooving is minimized since the grooves are positioned tangentially to the tube radius. As compared to flat tube sheet portions, the area available for grooving is minimized.

Another problem arises for headers of circular cross-section where the header has no access holes on the outer side of the header. Where there are access holes, the access holes are directly opposed to tubes which are connected to the tube sheet portion on the inner side of the header. Maintenance procedures typically utilize a straight rod to clean out the tubes. If the tubes are straight, the tubes can be cleaned with a mechanical cleaning device on the end of a straight rod. If the tubes are serpentine, the straight rods can clean out entrance and exit regions of the tubes, where solid particles tend to accumulate. If access holes do not exist, the tubes cannot be mechanically cleaned with external devices.

Another problem occurs for headers of circular or oval cross-section where threaded flat head shoulder plugs are used to plug access holes. The flat underside of the gasketed plug head does not fully engage with a curved surface. As a result for proper sealing, the access plug holes will require deep spot face machining to provide flat gasket surfaces on the curved plug sheet portion of the header which reduces the minimum thickness of the header wall resulting in additional material thickness in the header wall to contain a specified pressure. Tapered pipe thread plugs may also be utilized to seal access plug hole openings but utilization is limited to small diameter openings and containment of lower internal header pressures.

It is a primary object of this invention to minimize welding requirements.

It is another object of the invention to provide a header with minimal internal stress concentrations.

It is another object of the invention to provide a header with a minimum of right angle corners.

It is still another object of the invention to provide a header with a flat tube sheet portion on the inner side of the header for connection to fluid tubes.

It is yet another object of the invention to provide a header with access holes on a flat plug sheet portion to minimize required thickness of the header wall.

It is a further object of the invention to provide a header with threaded access plug holes on a flat surface which can be effectively sealed by plugs with either straight or tapered shanks.

SUMMARY OF THE INVENTION

The present invention is for an obround header of obround cross-section. The obround header of obround cross-section has longitudinal sidewalls with inner flat portions and outer flat portions and curved transitions between the opposed sidewalls. Openings in the inner flat tube sheet portion receive heat exchanger fluid tubes. Removable threaded plugs screw into threaded access plug holes in the outer flat plug sheet portion of the opposed sidewall. End plates are welded to ends of the header.

The flat portions of the sidewalls are parallel to each other and an access plug hole in the plug sheet portion of the header is directly opposite the tube hole in the tube sheet portion of the header. A centerline passing through each access plug hole is also a centerline of an opposed tube hole. The alignment of the corresponding holes permits a rolled and/or welded connection of each tube to the tube surface and cleaning of the fluid tubes with a straight rod inserted through the access plug hole.

One process for making an obround header is to compress a round pipe in a press to an obround cross-section. Another process for making such an obround cross-section is to extrude round pipe through an obround shaped die. Another process is to roll round pipe through a set of rollers. Other processes may exist for making obround headers.

DESCRIPTION OF THE PREFERRED EMBODIMENTS

Figure 1:
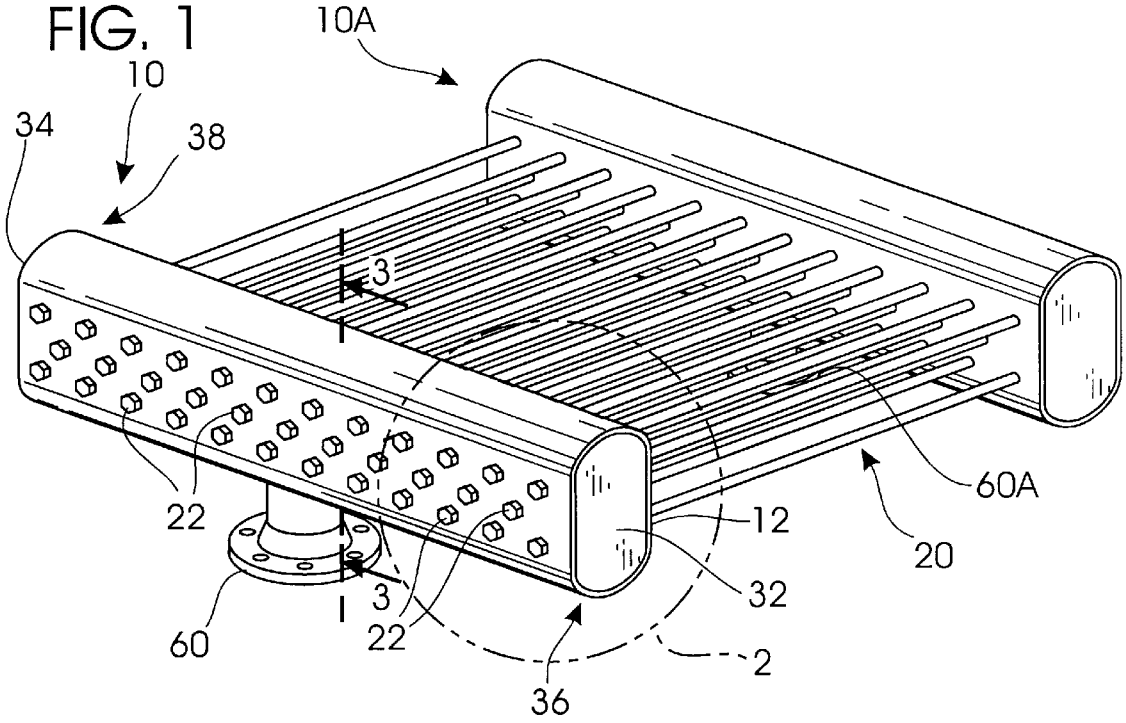
FIG. 1 is an isometric view of a typical air-cooled heat exchanger section with tubes between the present invention.
Figure 2:
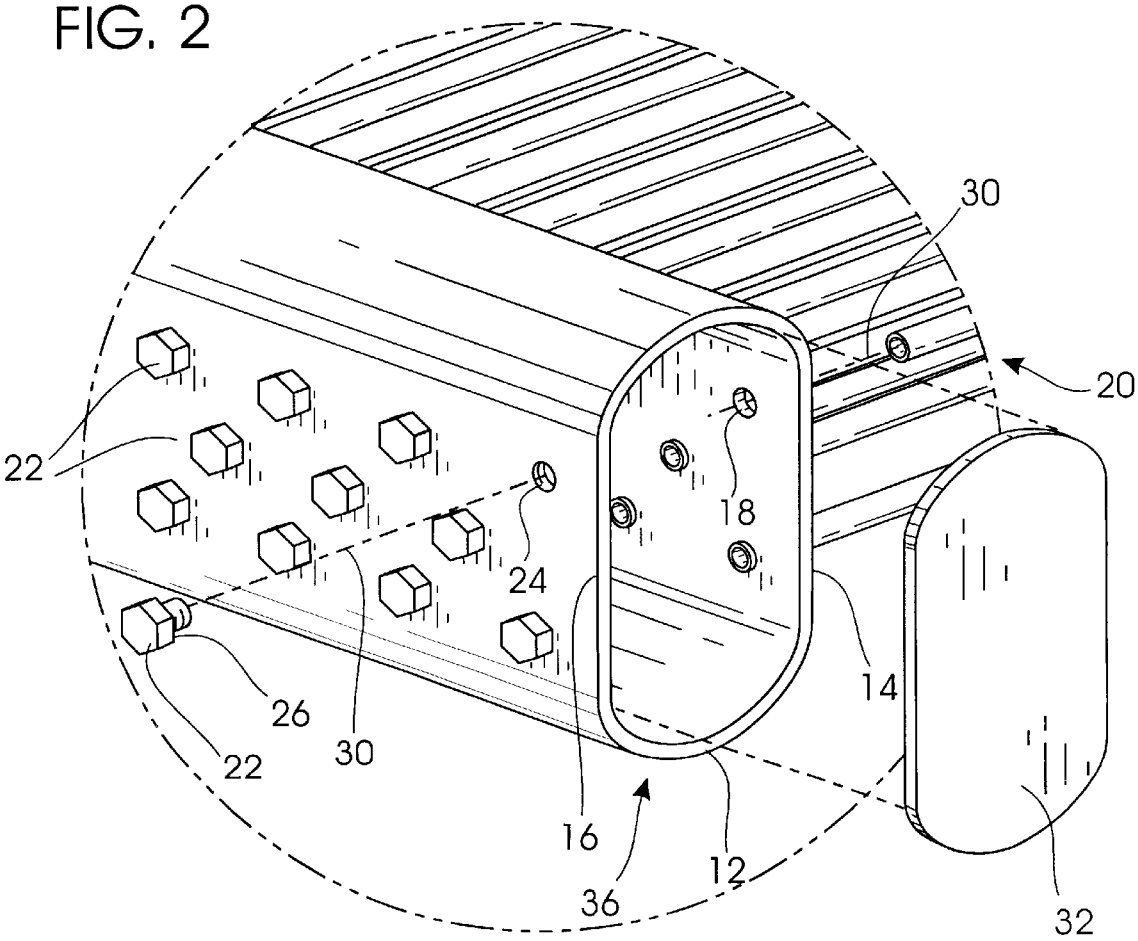
FIG. 2 is a cut-away side isometric view of the present invention with typical representation of access plugs, tubes, and nozzles.
Figure 3:
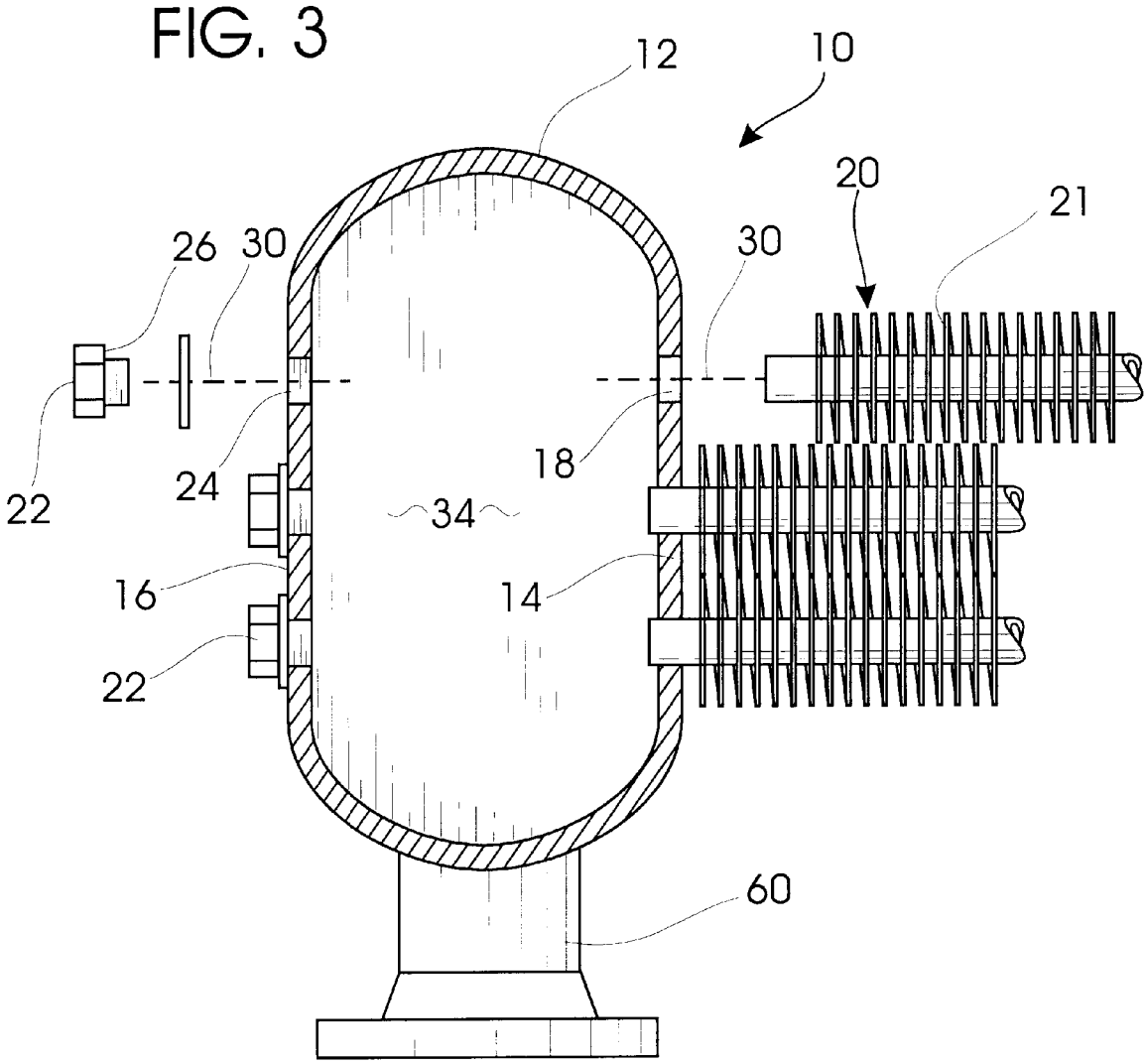
FIG. 3 is a cut-away side perspective view of the present invention.

Like numbers in the various figures refer to like parts of the various embodiments of the invention, except as otherwise noted.

As illustrated in the figures, header 10 of obround cross-section having a length, with a first end 36 and a second end 38, an inner flat sidewall, otherwise known as the tube sheet portion 14 and outer flat sidewall, otherwise known as the plug sheet portion 16 is shown. Tube sheet portion 14 has a plurality of tube holes 18, wherein each tube hole 18 receives a heat exchanger fluid tube 20 having a plurality of fins 21. Plug sheet portion 16 has a plurality of access plug holes 24, wherein each access plug hole 24 removably receives an access plug means 22. Access plug means 22 can be a shoulder plug which can be threadedly secured into its respective access plug hole 24. Shoulder plug means bottoms 26 are flat and seal against plug sheet portion 16 by means of a gasket. End plates 32 and 34 are welded to first end 36 and second end 38 of the header 10.

The tube sheet portion 14 and plug sheet portion 16 are parallel to each other and a single access plug hole 24 is directly opposite a tube hole 18. A centerline 30 passing through each access plug hole 24 is also a centerline of an opposed tube hole 18. The alignment of the access plug holes 24 and tube holes 18 permits securement of the tube by expansion of tube wall to the tube sheet portion with a tube expander tool (not shown) and/or by welding of tube wall to inner surface of tube sheet and cleaning of the fluid tubes 20 with mechanical tube cleaner connected to a straight rod (not shown). The fluid tubes 20 are secured to the tube sheet portion 14. A fluid inlet/outlet nozzle 60 having opening 61 is connected to the header 10 to supply fluid to or discharge fluid from the header 10. Nozzle 60 may be oval or circular in design.

Header 10 can be formed from material of a generally circular geometry such as round mechanical tubing, pipe, rolled shells or other similar material. The circular geometry of the material is altered to an generally obround geometry having at least two longitudinal flat surfaces, such as tube sheet portion 14 and plug sheet portion 16. The alteration can be performed by any standard hot or cold finishing process, such as rolling, extruding, forging, pressing or other similar process.

Header 10 can include reinforcement means (not shown) such as internal stays, tie bolts or other means to strengthen the pressure containment capability of the headers.

As shown in FIG. 6, two headers 10 and 10A are connected by heat exchanger fluid tubes 20. The parts of header 10A correspond to like parts for header 10, but a descriptor "A" is included after the parts for clarity.

In a typical air-cooled exchanger heat transfer operation, pressurized fluid enters into header 10A through port 60A. Due to the pressure drop of the fluid flowing inside the fluid tubes, the fluid pressure in inlet header 10 is lower than the fluid pressure in outlet header 10A, so that fluid flows through tubes 20 into header 10. Heat is removed from the fluid by drafting ambient air across tubes 20. The cooled fluid flows into header 10 and discharges through port 60.

Whereas, the present invention has been described in relation to the drawings attached hereto, it should be understood that other and further modifications, apart from those shown or suggested herein, may be made within the spirit and scope of this invention.

What is claimed is:

1. A header box for a heat exchanger having tubes to transport fluid, comprising:

(a) a header having a length with a first end and a second end, and having an obround cross-section with at least two longitudinal flat portions each having a plurality of openings, said two longitudinal flat portions being referred to as a tube sheet portion and a plug sheet portion;

(b) a tube in communication with each opening in said tube sheet portion; and (c) an access plug in communication with each opening in said plug sheet portion; and (d) a first end plate and second end plate rigidly attached to said first end and said second end of said header.

2. The header box of claim 1 wherein the cross-section of said header being further defined as having a longitudinal first flat portion referred to as a tube sheet portion and a longitudinal second flat portion referred to as a plug sheet portion.

3. The header box of claim 2 wherein said tube sheet portion is parallel to said plug sheet portion.

4. The header box of claim 3 wherein the number of said first tube sheet openings is the same as the number of said second plug sheet openings and are positioned directly opposite said second plug sheet openings.

5. The header box of claim 1 wherein said access plugs are removably secured into each second plug sheet opening.

6. The header box of claim 1 wherein said first and second end plates are welded to said first end and said second end of said header.

7. The header box of claim 1 further comprising at least one fluid port.

8. The header box of claim 1 further comprising reinforcement means located within the interior of said header.

9. A header box for a heat exchanger having tubes to transport fluid comprising:

(a) a header having a length with a first end and a second end and having an obround cross-section having a longitudinal tube sheet portion having a plurality of first tube sheet openings, and a longitudinal second flat plug sheet portion having a plurality of second plug sheet openings; wherein said first flat tube sheet portion is parallel to said second flat plug sheet portion and wherein the number of first tube sheet openings is the same as the number of second plug sheet openings and are positioned directly opposite said second plug sheet openings;

(b) a tube in communication with each first tube sheet opening;

(c) an access plug in communication with each second plug sheet opening; and (d) a first end plate and second end plate rigidly attached to a first end and a second end, respectively, of said header.

10. The header box of claim 9 wherein said access plugs are removably secured into each second plug sheet opening.

11. The header box of claim 9 wherein said first and second end plates are welded to said first end and said second end of said header.

12. The header box of claim 9 further comprising at least one fluid port.

13. The header box of claim 9 further comprising reinforcement means located within the interior of said header.

14. A header for use in a heat exchanger, said heat exchanger utilizing a plurality of tubes and a plurality of access plugs to assist in the transportation fluid, said header comprising:

(a) a main body portion having a first end and a second end, and having an obround cross-section, said obround cross-section having at least two longitudinal flat portions each having a plurality of openings, each of said openings being capable of receiving one of either said plurality of tubes or plurality of access plugs; and (b) a first end plate and second end plate rigidly attached to said first end and said second end of said header.

15. The header of claim 14 wherein the cross-section of said header being defined as having a tube sheet portion having a plurality of tube openings, wherein each of said tube openings are designed to receive one of said plurality of tubes, and a plug sheet portion having a plurality of plug openings, wherein each of said plug openings is designed to receive one of said access plugs, wherein both sheet portions are substantially flat.

16. The header box of claim 15 wherein said tube sheet portion is substantially parallel to said plug sheet portion.

17. The header box of claim 16 wherein the number of said tube openings is the same as the number of said plug openings, and each tube opening is positioned directly opposite one of said plug openings.

18. The header box of claim 14 wherein said main body portion is further defined as being formed from material of a generally circular cross-section geometry into a generally obround cross-section having at least two longitudinal flat portions, said forming being performed by a finishing process.

19. The header box of claim 18 wherein said finishing process is process selected from the group consisting of hot rolling, cold rolling, hot extruding, cold extruding, hot forging, cold forging, hot pressing and cold pressing.

* * * * *